US006483064B2

(12) United States Patent
Dufournet et al.

(10) Patent No.: US 6,483,064 B2
(45) Date of Patent: Nov. 19, 2002

(54) INSULATING BLAST NOZZLE FOR A CIRCUIT BREAKER

(75) Inventors: Denis Dufournet, Sathonay-Camp (FR); Wolfgang Grieshaber, Lyons (FR); Michel Perret, Bourgoin-Jallieu (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/841,604

(22) Filed: Apr. 25, 2001

(65) Prior Publication Data

US 2001/0045410 A1 Nov. 29, 2001

(30) Foreign Application Priority Data

May 25, 2000 (FR) ..... 00 06684

(51) Int. Cl.[7] ..... H01H 33/70

(52) U.S. Cl. ..... 218/53; 218/43; 218/62; 218/64

(58) Field of Search ..... 218/43, 45, 48–54, 218/59, 62, 63–66, 72–74, 78, 84, 154

(56) References Cited

U.S. PATENT DOCUMENTS 6,015,960 A * 1/2000 Girodet et al. ..... 218/43

6,040,970 A * 3/2000 Lehmann et al. ..... 361/115

FOREIGN PATENT DOCUMENTS

| | | |
|---|---|---|
| EP | 0 028 039 | 5/1981 |
| EP | 0 135 158 | 3/1985 |
| FR | 2 370 352 | 6/1978 |

* cited by examiner

*Primary Examiner*—Lincoln Donovan
*Assistant Examiner*—Tuyen T. Nguyen
(74) *Attorney, Agent, or Firm*—Sughrue Mion, PLLC

(57) ABSTRACT

An insulating blast nozzle for a circuit breaker, the circuit breaker having a first arcing contact and a second arcing contact that separate from each other when the circuit breaker is opened subsequent to prior separation of permanent contacts, said insulating blast nozzle being secured to one of the permanent contacts and being generally horn-shaped, having a throat and defining a volume of revolution having an upstream portion and a downstream portion joined by the throat, in which the inside volume is cylindrical and closed by the second arcing contact when the circuit breaker is closed and for a few milliseconds after the arcing contacts have separated, the wall of the nozzle in its portion defining the upstream portion of said volume of revolution surrounding said first arcing contact, the downstream portion of said volume comprising a first conical portion, wherein said first conical portion is followed by a second conical portion having a flare angle that is more open than that of said first conical portion.

6 Claims, 5 Drawing Sheets

INSULATING BLAST NOZZLE FOR A CIRCUIT BREAKER

The present invention relates to an insulating blast nozzle for a circuit breaker. The invention applies in particular to high-voltage circuit breakers, for voltages equal to or greater than 300 kV, and including only one break chamber per pole.

BACKGROUND OF THE INVENTION

The nozzle must enable circuit breaking to be performed over the entire required interruption window and for currents going up to the short-circuit breaking capacity.

The problem occurs due to the high value of the transient recovery voltage that exists in such very high voltage circuit breakers having only one break per pole.

Many types of insulating blast nozzles are known, but they are not suitable for such applications.

For the gas to be able to recover its dielectric capacity, gas temperatures must be below a critical value of about 2000° C., and the density of the blast gas must also be sufficient.

European patent EP 0 028 039 describes a compressed-gas circuit breaker comprising an insulating blast nozzle having an internal profile that comprises a cylindrical portion followed by a conical portion and then by another cylindrical portion.

Experience shows that a nozzle shaped in that way is not optimal since the temperature of the gas is too high in the downstream portion of the nozzle, and its dielectric capacity deteriorates after breaking due to turbulence.

OBJECTS AND SUMMARY OF THE INVENTION

The present invention proposes an insulating nozzle ensuring, in the downstream portion thereof, a better flow of gas and an improved range of temperatures, thus enabling the circuit breaker to withstand a higher voltage after the current has been interrupted.

The invention thus provides an insulating blast nozzle for a circuit breaker, the circuit breaker having a first arcing contact and a second arcing contact that separate from each other when the circuit breaker is opened subsequent to prior separation of permanent contacts, said insulating blast nozzle being secured to one of the permanent contacts and being generally horn-shaped, having a throat and defining a volume of revolution having an upstream portion and a downstream portion joined by the throat, in which the inside volume is cylindrical and closed by the second arcing contact when the circuit breaker is closed and for a few milliseconds after the arcing contacts have separated, the wall of the nozzle in its portion defining the upstream portion of said volume of revolution surrounding said first arcing contact, the downstream portion of said volume comprising a first conical portion, wherein said first conical portion is followed by a second conical portion having a flare angle that is more open than that of said first conical portion.

In practice, the angle of the first conical portion lies in the range 8° to 17°, and is preferably in the range 10° to 12°, and the angle of the second conical portion lies in the range 12° to 25°, and is preferably in the range 14° to 17°.

According to another characteristic and taking account of the separation speed of the arcing contacts, the lengths of said throat, of the first conical portion, and of the second conical portion are dimensioned in such a manner that the end of the second arcing contact is situated inside the first conical portion during an arcing duration lying between a minimum arcing duration and an average arcing duration, and is situated inside the second conical portion during an arcing duration lying between the average arcing duration and a maximum arcing duration.

According to another characteristic, the first conical portion beginning after said cylindrical portion starts with an inside diameter that is greater than the inside of the cylindrical portion, thereby forming a sudden step at the outlet of the cylindrical portion.

This enables an intense blast to be achieved as soon as the second arcing contact leaves said cylindrical portion, referred to as the "nozzle throat", and enables possible duration of arcing to be shorter.

BRIEF DESCRIPTION OF THE DRAWINGS

The description of an embodiment of the invention is given below with reference to the accompanying drawings, in which.

MORE DETAILED DESCRIPTION

Figure 1:
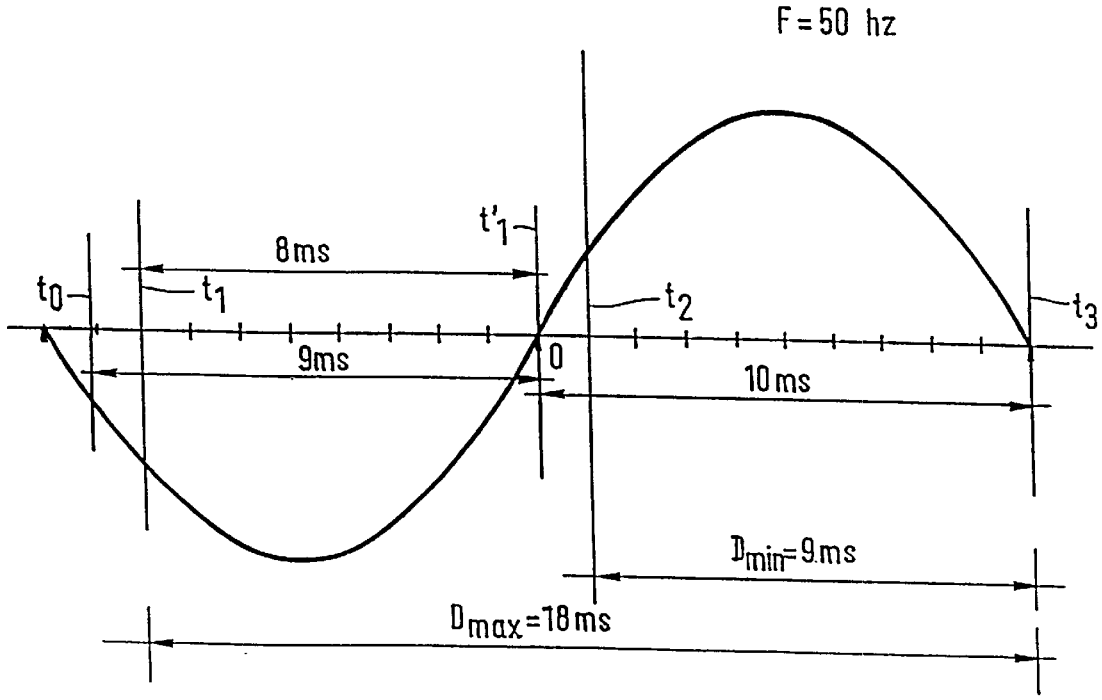
FIG. 1 is a graph showing a current waveform for a 50 Hz electricity grid, and showing the break window corresponding to the possible during of arcing between contact separation and extinction, said duration being variable depending on the moment within the waveform at which said separation takes place.

FIG. 1 shows a current waveform indicating the minimum arcing duration: Dmin=9 ms, and the maximum arcing duration: Dmax=18 ms (for a 50 Hz grid), depending on the moment at which the arcing contacts of a circuit breaker separate within the current waveform.

Thus, if contact separation takes place at time $t_2$, i.e. at least 9 ms before the current passes through 0, interruption will be final the next time the current passes through 0, i.e. at point $t_3$; however, if contact separation takes place less than 9 ms before the current next passes through 0 (e.g. at time $t_1$, 8 ms before the current passes through 0), the arc will re-strike after $t'_1$ and interruption will be final only at $t_3$. The duration of arcing can thus vary from 9 ms to 18 ms, and even up to 19 ms-e if separation takes place immediately after $t_0$ situated 9 ms before $t'_1$.

Figure 2:
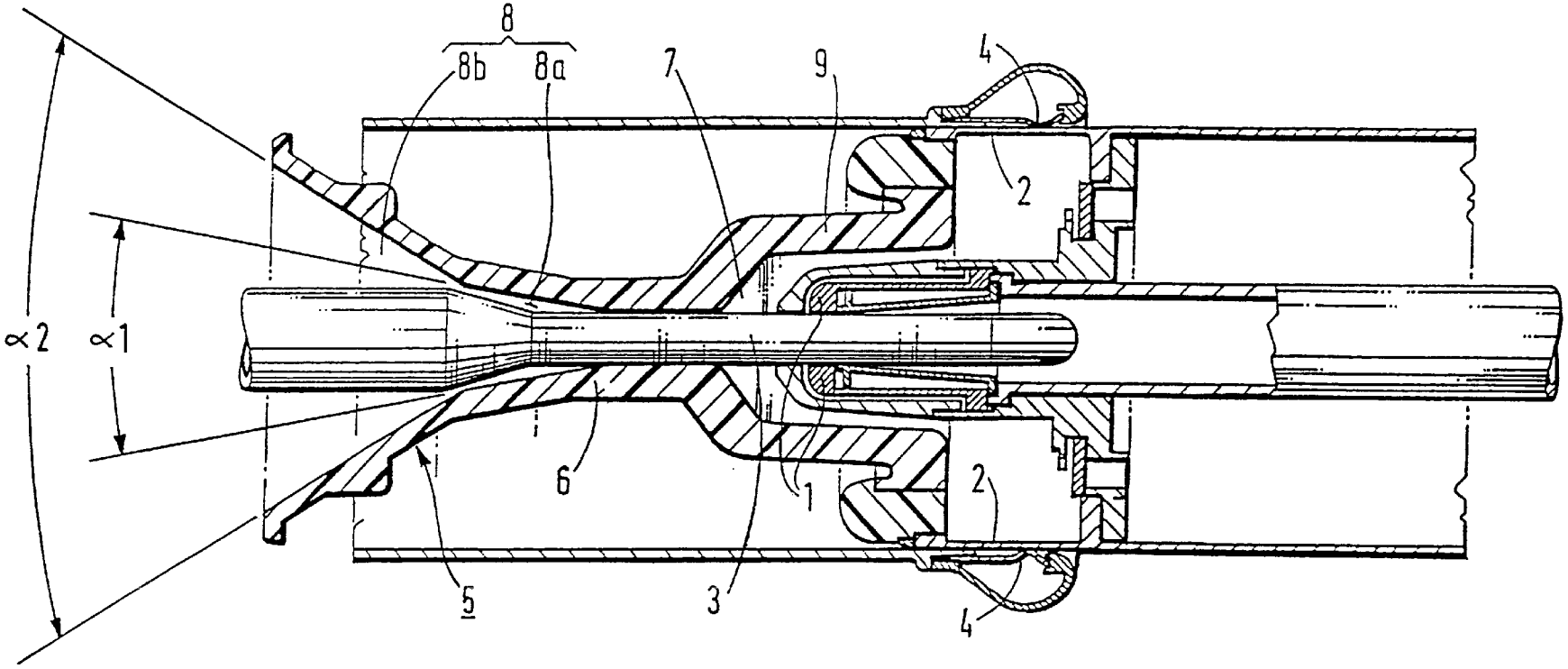
FIGS. 2, 3, and 4 are fragmentary views of the nozzle of the invention in a high-voltage circuit breaker, showing the contact parts of the circuit breaker respectively in the closed position and in two intermediate opening positions.

FIG. 2 is a fragmentary view showing a circuit breaker and more particularly its contact parts and the insulating blast nozzle of the invention.

It thus shows a first arcing contact 1, referred to as a "moving arcing contact", securely connected to first permanent contacts 2, referred to as "moving permanent contacts". In addition, it also shows a second arcing contact 3, referred to as a "fixed arcing contact", and second permanent contacts 4, referred to as "fixed permanent contacts". Finally, a blast nozzle 5 is connected to the moving permanent contacts 2.

The contacts 2 and 4 are referred to as "permanent" contacts since it is through them that the current mainly passes when the circuit breaker is in the closed position, as shown in FIG. 2. When the circuit-breaker is opened, the permanent contacts 2 and 4 separate first, before separation of the arcing contacts 1 and 3 between which an arc forms at the moment of separation and until the final interruption.

In the example shown, the contacts 1 and 2 are also referred to as "moving" contacts, and the contacts 3 and 4 are referred to as "fixed" contacts since, at the moment of opening, only the contacts 1 and 2 are displaced towards the right of the figure. However, the nozzle, i.e. the subject matter of the invention, can also apply to circuit breakers referred to as "dual moving contact" circuit breakers.

As can be seen, the insulating blast nozzle 5 is generally horn-shaped, defining a volume of revolution. The nozzle 5 has a throat 6 which separates the volume of revolution into an upstream portion 7 and a downstream portion 8. At the location of the throat 6, the inside volume is cylindrical and, as shown in FIG. 2, it is closed by the fixed arcing contact 3, both when the circuit breaker is in the closed position and for a few milliseconds after the arcing contacts 1 and 3 have separated.

The wall of the nozzle 5, in its portion 9 defining the upstream portion 7 of the inside volume, surrounds the first or moving arcing contact 1.

The downstream portion 8 of the inside volume defined by the nozzle 5 comprises a first conical portion 8*a* immediately following the throat 6, having an angle $\alpha 1$ lying in the range 8° to 17°, and preferably in the range 10° to 12°. This conical portion 8*a* is followed by a second portion 8*b* that is also conical and has an angle $\alpha 2$ lying in the range 12° to 25°, and preferably in the range 14° to 17°.

Figure 3:
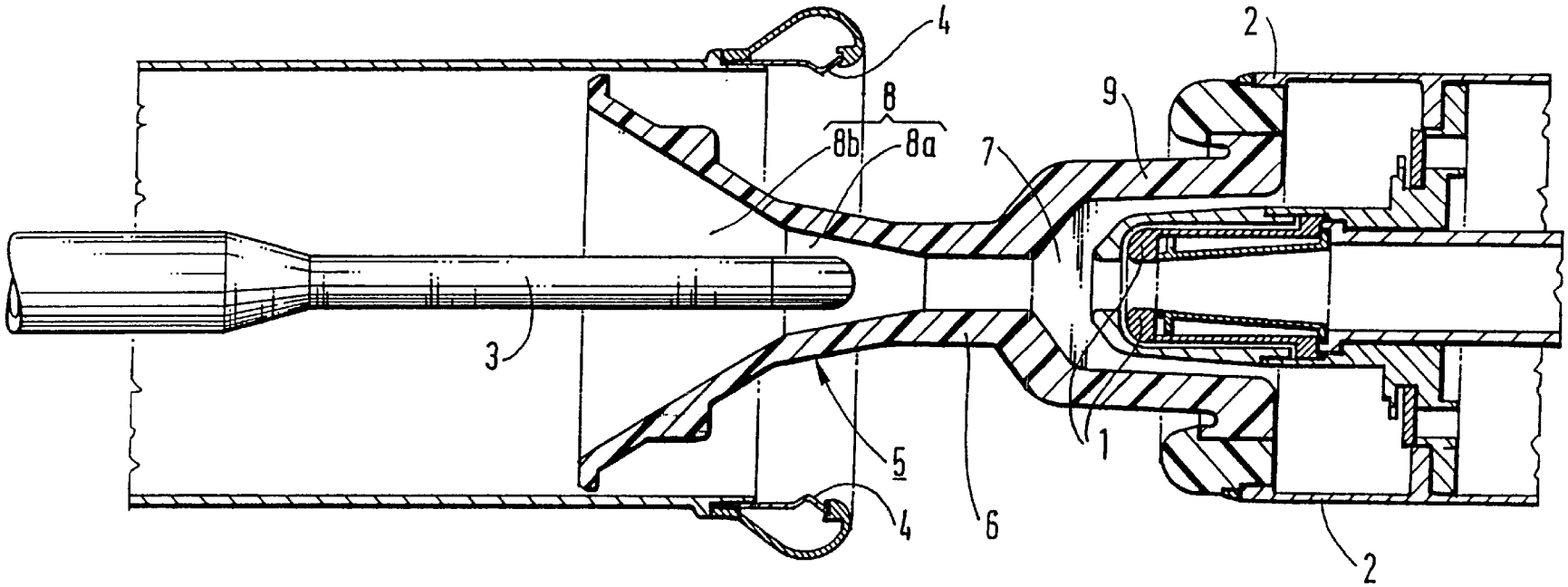
Figure 4:
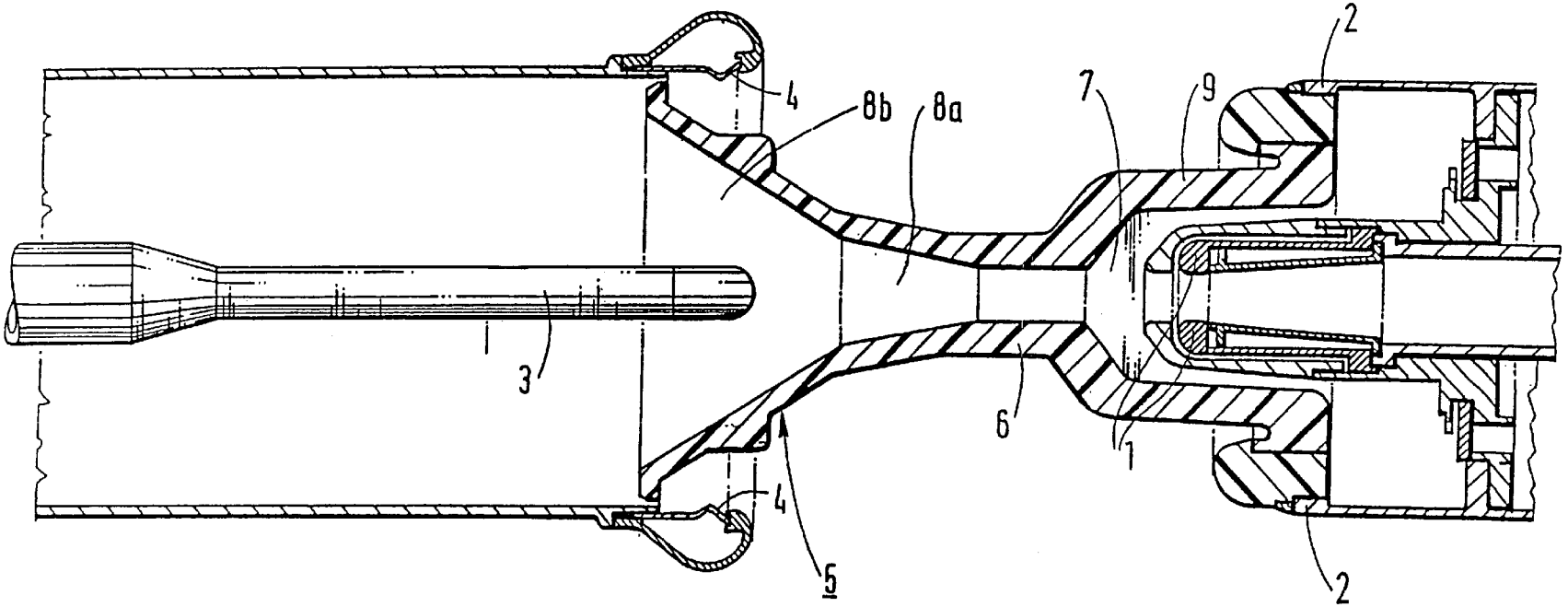

The lengths of the various portions, i.e. the throat 6 together with the first conical portion 8*a* and the second conical portion 8*b*, are calculated, taking account of the separation speed of the contacts, so that the end of the second arcing contact 3 is situated inside the first conical portion 8*a*, as shown in FIG. 3, in the time period lying between the minimum duration of arcing and the average duration of arcing after the contacts have separated, i.e. approximately in the time period lying in the range 9 ms to 13.5 ms or 14 ms after the contacts have separated, for a 50 Hz grid, as shown in FIG. 1, and so that said same end of the second arcing contact 3 is situated inside the second conical portion 8*b*, as shown in FIG. 4, in the time period lying between the average duration of arcing and a maximum duration of arcing after the contacts have separated, and thus approximately in the time period lying in the range 13.5 to 18 ms or 19 ms after the contacts have separated.

Thus, by means of such a nozzle, an acceptable gas temperature and a sufficiently high pressure field is obtained in the downstream portion of the nozzle so as to cool the contacts sufficiently and remove heat.

The cylindrical portion at the throat 6 is closed by the contact 3 for a few milliseconds after the contacts have separated. The energy of the arc in the blast volume is thus transmitted without the gas being able to escape via the nozzle. An increase in pressure is thus achieved.

Then, the first conical portion 8*a* enables sufficient extra pressure to be conserved while maintaining an acceptable gas temperature and while avoiding turbulence, and the second, more open, conical portion 8*b*, prevents the pressure being too high at the outlet of the nozzle, thus preventing breakdown of the dielectric resulting from insufficient removal of hot gases from the diverging portion of the nozzle.

Figure 5:
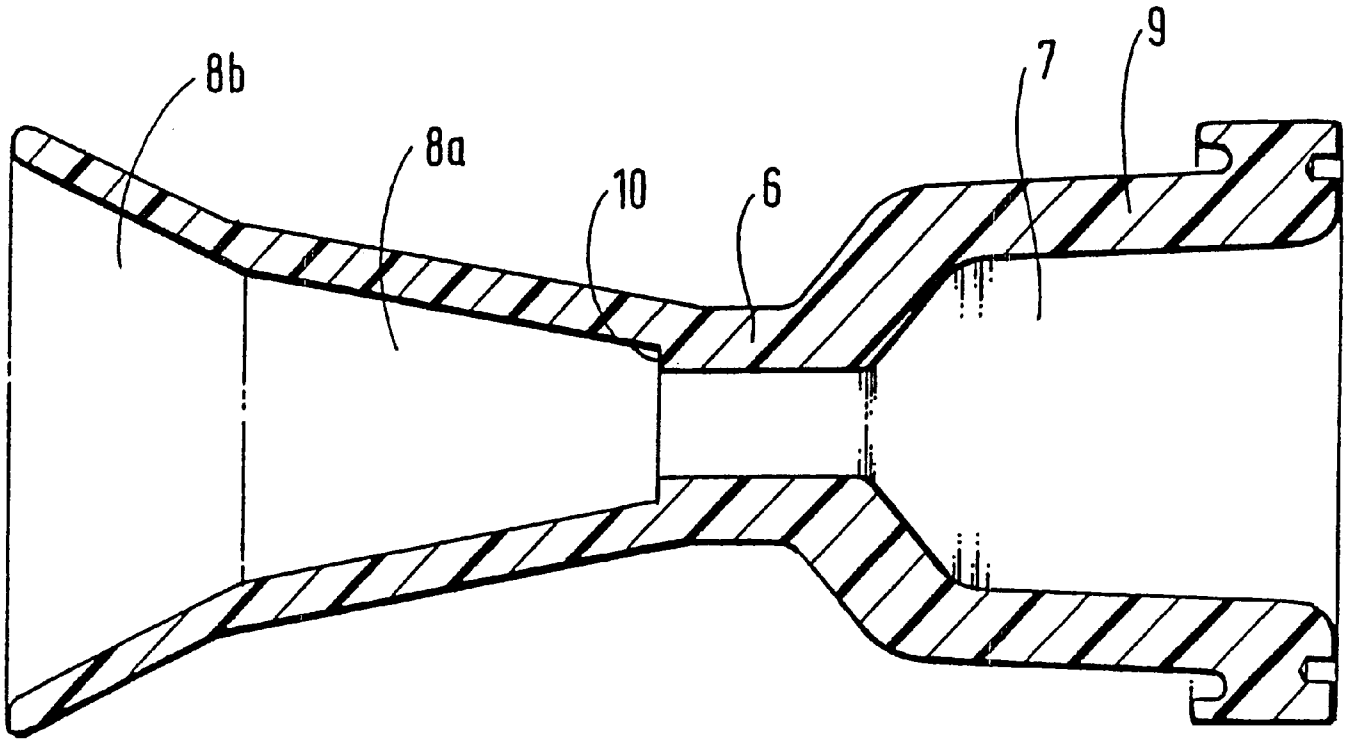
FIG. 5 shows a variant embodiment of an insulating nozzle of the invention on its own.

FIG. 5 shows an insulating nozzle in a variant of the invention. In this variant, the first conical portion 8*a*, which begins immediately after the throat 6, starts with an inside diameter that is greater than that of the throat 6. There is thus a sudden step 10 at the outlet of the throat 6. This enables an intense blast to be achieved as soon as the contact 3 leaves the throat 6 of the nozzle and thus enables the possible duration of arcing to be shorter.

What is claimed is:

1. An insulating blast nozzle for a circuit breaker, the circuit breaker having a first arcing contact and a second arcing contact that separate from each other when the circuit breaker is opened subsequent to prior separation of permanent contacts, said insulating blast nozzle being secured to one of the permanent contacts and being horn-shaped, having a throat and defining a volume of revolution having an upstream portion and a downstream portion joined by the throat, in which an inside volume is cylindrical and closed by the second arcing contact when the circuit breaker is closed, the wall of the nozzle in the upstream portion of said volume of revolution surrounding said first arcing contact, the downstream portion of said volume of revolution comprising a first conical portion comprising a first flare angle, wherein said first conical portion is followed by a second conical portion comprising a second flare angle, wherein said second flare angle is larger than said first flare angle.

2. An insulating nozzle according to claim 1, wherein the angle of said first conical portion lies in the range 8° to 17°, and wherein the angle of said second conical portion lies in the range 12° to 25°.

3. An insulating nozzle according to claim 2, wherein the angle of the first conical portion lies in the range 10° to 12°.

4. An insulating nozzle according to claim 2, wherein the angle of said second conical portion lies in the range 14° to 17°.

5. An insulating nozzle according to claim 1, wherein, taking account of the separation speed of the arcing contacts, the lengths of said throat, of the first conical portion, and of the second conical portion are dimensioned in such a manner that the end of the second arcing contact is situated inside the first conical portion during an arcing duration lying between a minimum arcing duration and an average arcing duration, and is situated inside the second conical portion during an arcing duration lying between the average arcing duration and a maximum arcing duration.

6. An insulating nozzle according to claim 1, wherein said first conical portion begins adjacent said throat and starts with an inside diameter that is greater than the inside diameter of said throat, thereby forming a sudden step.

* * * * *